United States Patent [19]

Johnson, Jr.

Best Available Copy

[11] 4,297,961

[45] Nov. 3, 1981

[54] OUTRIGGER-STABILIZED FLOATING CRANE SYSTEM

[75] Inventor: Fontain M. Johnson, Jr., St. Louis County, Mo.

[73] Assignee: Weaver Shipyard and Drydock, Inc., Orange, Tex.

[21] Appl. No.: 108,514

[22] Filed: Dec. 31, 1979

[51] Int. Cl.[3] ..... B63B 43/14; B66C 23/52

[52] U.S. Cl. ..... 114/123; 212/191

[58] Field of Search ..... 114/123, 264, 268; 212/190, 191, 192; 9/8 P

[56] References Cited

U.S. PATENT DOCUMENTS

| | | | |
|---|---|---|---|
| 1,709,219 | 4/1929 | Hille | 114/123 |
| 2,596,194 | 5/1952 | Anderson | 114/123 |
| 3,150,628 | 9/1964 | Brinkmann et al. | 114/123 |
| 3,304,898 | 2/1967 | Sainte-Claire | 114/123 X |
| 3,978,805 | 9/1976 | Thomas | 114/123 X |

FOREIGN PATENT DOCUMENTS

| | | | |
|---|---|---|---|
| 61898 | 10/1913 | Austria | 212/190 |
| 964723 | 5/1957 | Fed. Rep. of Germany | 212/190 |
| 341044 | 9/1971 | Fed. Rep. of Germany | 212/190 |

*Primary Examiner*—John A. Pekar

*Attorney, Agent, or Firm*—Jerome A. Gross

[57] ABSTRACT

A crane barge mounting a boom crane aft of its longitudinal center of flotation is provided with a plurality of box-type outrigger barges coupled at its sides to limit list and trim of the crane barge and so protect the crane boom from collapse. The outrigger mounting structure for each outrigger barge is comprised of a pair of removable spaced-apart parallel beams extending horizontally from moment-resisting connections at beam seats on the edge of the crane barge deck to structural hinge or pivot mount connections over the transverse center of flotation of the outrigger barge, spacing the outrigger and crane barges by such distance as to avoid contact of their sides on listing of the crane barge, so that the deck of the outrigger barge may provide a level working surface. Each outrigger barge is so ballasted that the mounting bores for the beams on the beam seat and on the pivot mount are at the same level, when the crane is unloaded, providing easy insertion and removal of connector pins.

22 Claims, 7 Drawing Figures

W
c
30
CF
CB
c
22
21
30
20
10
c

W
d
CF
CB
d
22
21
20
10
d

W
80
82
83
84
81
10
13
16
32
60
60
52
50
50
52
30

OUTRIGGER-STABILIZED FLOATING CRANE SYSTEM

BACKGROUND OF THE INVENTION

The present invention relates to barge-mounted cranes utilized for lifting extremely heavy loads, such as in bridge building. More generally, it relates to increasing the stability of vessels, such as barges, upon which large external moments are applied, such as lifting heavy weight over the side of the vessel by a crane mounted thereon.

Cranes, such as of the boom type, have long been mounted on barges, floating platforms, or other boats and utilized for various purposes, such as loading and unloading of ships and barges, ship repair, reclaiming sunken ships, and bridge building. The size of crane barges must be limited, especially the width, to permit passage through locks, canals and other narrow inland waterways. Similarly, other economic or design constraints may limit the length, breadth or draft of any type of floating vessel.

In use of crane barges, extremely heavy loads, several times the unloaded displacement of the barge, sometimes need to be so lifted to considerable horizontal distances from the barge, particularly for bridge building. When utilizing a barge-mounted crane for lifting these heavy loads, such as a large section of a bridge weighing hundreds of tons, the barge may list or trim severely, and the draft will increase substantially. If the inclination, especially listing, should become too great, the crane barge may become unstable, and could capsize rather than right itself. At lesser angles the deck of the barge may be an unsafe working surface. Such tilting of the barge may make control of the crane uncertain. Likewise, any type of boat or vessel which normally has positive stability, conventionally defined by having its center of gravity beneath its metacentre, may become unstable when a large external moment is applied, such as caused by improper loading or wave action.

The truss-like boom of a barge-mounted crane, for example, which may be several times longer than the length of the barge, has little strength except in its plane. Since the crane is normally positioned aft of the center of flotation of the barge to facilitate lifting over the end of the barge, lifting over the side of the barge may cause the crane boom to tilt aft from its normal substantially vertical plane due to aft sinkage of the barge. Similarly, lifting over a corner of the crane barge, rather than directly over an end or side, may cause a similar condition due to simultaneous listing and trimming of the barge. Also, the crane boom is subject to high wind loads normal to the vertical plane of the boom, which effects sideward shear on the boom and a moment at the connection of the boom to the barge, causing the barge to list or become out of trim and the plane of the boom to tilt from vertical. In these cases when the boom tilts from vertical, any suspended load presents a sideward component of force which is likely to collapse the boom. Tilting out of the vertical by one degree or even less may endanger the crane. Other types of vessels may be endangered by unsymmetrical loads, whether or not accompanied by wind forces.

SUMMARY OF THE INVENTION

An object of the present invention is to provide means to increase the stability of a barge, ship, or other vessel or floating platform so as to resist externally applied moments and thereby reduce the resulting list or trim. More specifically, an object is to provide a crane barge system for which trimming and listing is minimized during lifting of extremely heavy loads. Another object is to provide such a floating crane system which resists side wind forces on the crane boom and inclination of the vessel causing the boom to tilt from a vertical plane, which might cause collapse of the boom under load. A still further object is to provide means for supplemental stabilization of a vessel of ordinary dimensions in which the means may be readily removed or withdrawn for transport.

Briefly described, the present invention comprises a larger rectangular-shaped central crane barge (or other floating platform or vessel) such as for mounting a boom crane, together with one or more stable outrigger barges (or other stable flotation devices of substantial displacement), usually mounted at the sides of the crane vessel. A preferred manner of coupling is by a pair of parallel spaced-apart beams or trusses extending sideward from a moment connection at beam seats along the upper side of the crane-mounting vessel to longitudinally aligned pivot connections over the transverse center of flotation of the outrigger. The buoyancy of the outriggers largely overcomes the tendency of the crane barge to list or trim on lifting of heavy loads over its sides or end, thereby minimizing tilting of the boom out of the vertical. By hinging movement on their pivot connections to the beams, the outriggers remain level despite the remaining minor listing movement of the crane-mounted vessel.

Each beam may be connected to its beam seat by a pair of horizontal transverse horizontally-spaced removable pins, while the pivot mount to the outrigger has a similar removable pin, so that the outriggers may be disconnected and the beams removed, as for transport of the crane-mounted vessel. Since the connection of the outrigger to the beam is made by only two pins, aligned on a horizontal axis, no difficulty may be encountered in coupling, even if the beams or pivot mounts should become slightly displaced after repeated connection and disconnection. Normally, both of the beam seats of an outrigger are located on the same side of the longitudinal center of flotation of the crane-mounting vessel; the relatively short spacing between them minimizes the shear forces on the outriggers when the crane-mounting vessel is out of trim. One of the pair of bores in the beam seat which accept the removable pins may be horizontally enlarged to facilitate insertion and removal of the pins, without lessening the ability of the beam seat to resist bending moment.

The outriggers are preferably barges of the wall-sided or box type, and are ballasted for draft at substantially below their vertical mid-height, when the crane-mounting vessel (such as a barge), to which it is coupled, is normally loaded with its crane unloaded. The outrigger barges may then be readily attached or detached, because with the beam in place on the beam seat, the pivot mount bore and its corresponding bore in the beam are then on the same horizontal level so that alignment of the bores and insertion of the pivot pin are easily performed.

On loading of the crane, the added weight will cause the draft of the outriggers to increase somewhat, preferably until they are substantially halfsubmerged. Then, the outrigger remains partially submerged for substantially equal maximum angles of list of the crane-mounting vessel or barge to either port or starboard. Over this range of angles for which the outrigger is partially submerged, the resistance to list provided by each outrigger varies as a function of the angle of list of the crane-mounting vessel. As the outrigger is forced deeper into the water, the buoyant force provided by the outrigger increases proportionally.

The spacing between the crane barge and outrigger barges, for example, is sufficient to permit the crane barge to list to the selected maximum angle while the outrigger barges pivot to remain level, without contacting the adjacent sides of the crane barge.

DESCRIPTION OF THE PREFERRED EMBODIMENT

Figure 1:
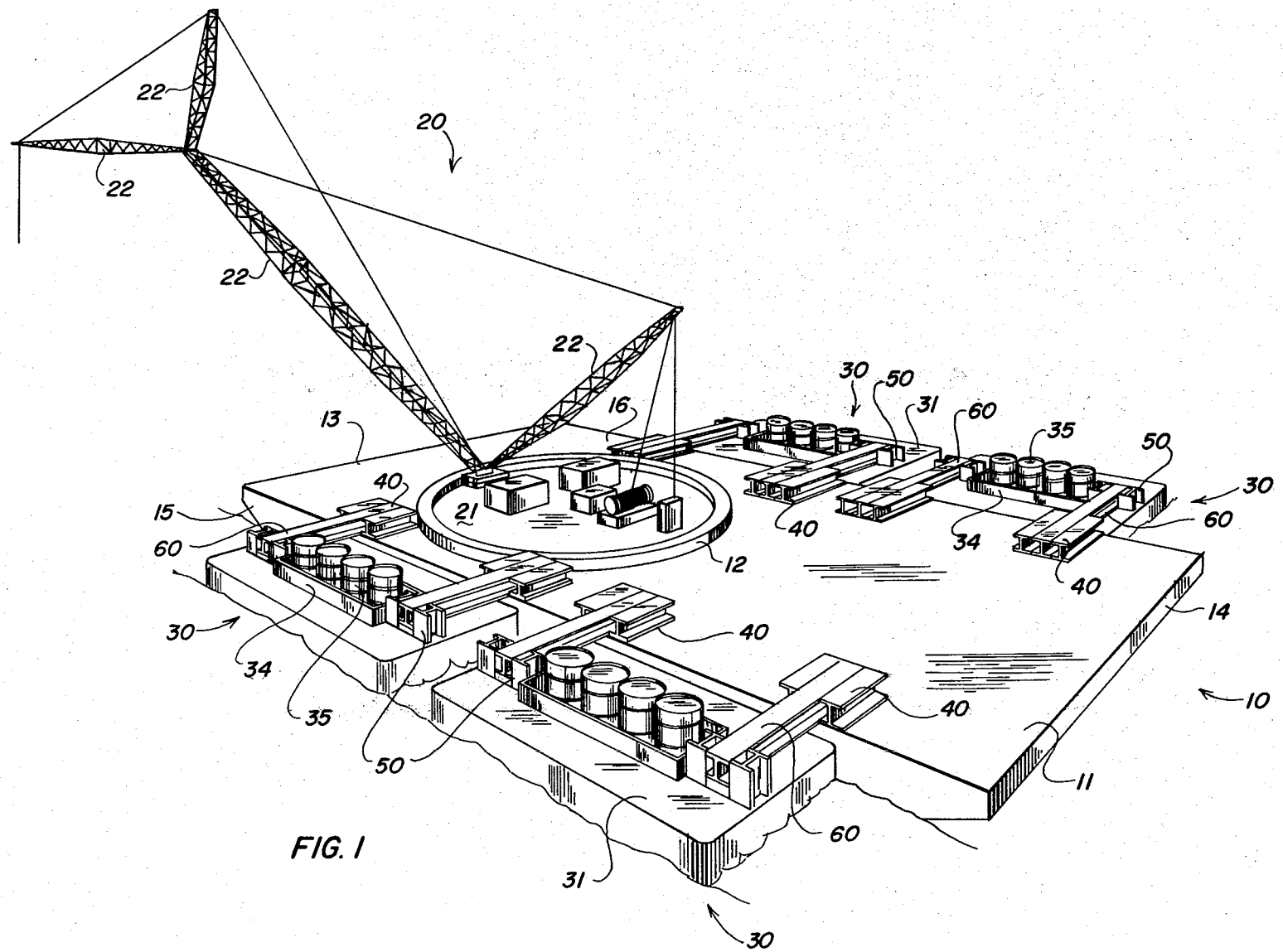
FIG. 1 is a top oblique projection of a preferred embodiment of the outrigger-stabilized floating crane system, shown with a boom crane mounted on and extended over the aft end of a crane barge and having four outrigger barges.

The preferred embodiment of the present invention, an outrigger-stabilized floating crane barge system, is illustrated as advantageously used in bridge building. As shown in FIG. 1, the preferred embodiment comprises a central crane barge, generally designated 10, upon which is mounted a boom crane, generally designated 20. Two outrigger barges, generally designated 30, are coupled at each of the sides of the crane barge, each outrigger barge being coupled by a pair of cantilever beams 60 extending from moment-resisting connections at beam seats 40 on the crane barge 10 to pivot connections at pivot mounts 50 on the longitudinally-extending centerlines of the outrigger barges 30.

Nautical Terms Utilized

The displacement of a floating vessel—the weight of that quantity of water it displaces—represents an upward buoyant force on the vessel, equal to the weight of the vessel. Changing the draft, the depth of the vessel in the water, such as by increasing the vessel's load, correspondingly increases the displacement. This upward buoyant force may be considered as acting vertically through a point known as the center of buoyancy, marked as "CB" on the accompanying drawings, located at the volume centroid of the displaced water, its precise position being a function of the draft and inclination of the vessel. The level of the waterline on the vessel establishes its waterplane W; the area centroid of the vessel at the level of the waterplane is known as the vessel's center of flotation, marked as "CF" on the accompanying drawings. Application of an externally applied moment to the vessel, which might result from wind or from an unsymmetrical load, such as lifting of a weight over the side of the vessel by a crane mounted thereon, causes listing or trimming of the vessel. List or heel is athwartship inclination, or the rotation of the vessel about a longitudinal axis representing its transverse center of flotation, while trim is the longitudinal inclination, or rotation of the floating object about a transverse axis representing its longitudinal center of flotation.

No matter what external moment is applied, a vessel will tend to an equilibrium position. The tendency of a vessel to reach an equilibrium position without capsizing upon application of an externally applied moment tending to list or trim the vessel is known as its intact stability. A vessel is said to have positive stability when its center of gravity is beneath its metacentre, the point on the vertical line through the center of buoyancy CB which intersects the vertical centerline of the vessel. The distance between the two points is known as "GM"; the greater its positive value, the greater the vessel's stability. Thus, most floating objects constructed for utility purposes are designed with positive stability (positive GM); they will right themselves after being subjected to a temporary externally applied moment, as well as resist list or trim during the time that the externally applied moment is being experienced.

Crane Barge

Now describing the preferred embodiment of the present invention in detail, the central crane barge 10 is of conventional construction, being, in the preferred embodiment illustrated, about two hundred feet long, seventy feet wide and ten feet in vertical height. The upper side or deck 11 of the crane barge 10 has a crane mounting provision or crane ring 12 for mounting the boom crane 20, located nearer the aft end 13 than the forward end 14 of the barge 10, so that the crane 20 is mounted aft of the longitudinal center of flotation CF of the crane barge 10, as is conventional to facilitate lifting over the aft end 13 of the crane barge 10, as shown in FIG. 1. The crane ring 12 is centered halfway between the starboard or right side 15 and the port or left side 16 of the crane barge, therefore being over the longitudinal centerline of the crane barge 10, and since it is a symmetrical vessel, over its transverse center of flotation.

The conventional boom crane 20, as shown in FIG. 1, mounted for rotation on the crane ring 12, is made up of a platform 21 mounting trusses 22 forming the crane boom which extends, in this embodiment, over four hundred feet from the platform 21, supported by cables in a vertical plane. The crane 20 is capable of lifting very large loads, such as a section of a bridge weighing hundreds of tons, and may move such loads over substantial distances from the barge.

In the conventional construction so far described, several problems are encountered in moving such large loads. When lifting over the side of the crane barge, the center of gravity of the combination of the barge, the crane and its heavy load may be at a higher level than the metacenter, and the crane barge 10 may list severely, as shown by the angle b in FIG. 4. Under such a condition, the floating crane system could capsize. Otherwise, the extreme inclination of the deck 11 of the crane barge 10 may make working conditions quite difficult. Similarly, lifting over the aft or forward ends 13, 14 of the crane barge 10 may similarly cause the crane barge to trim; though danger of capsizing is not as likely due to the longer length of the crane barge 10, the working conditions may be unsuitable, especially if the deck 11 should be wet.

List or trim of the crane barge may result in severe stresses being imposed on the crane 20. Since the crane boom is of a truss-like construction, its principal strength is in the plane of the boom; it can safely support only loads acting substantially in that plane. However, two considerations may cause the plane of the boom to tilt from vertical, shown in FIG. 6 as angle d, so that a load vertically suspended from the boom by a cable has a force component out of the plane of the boom, which may cause its collapse. First, with the conventional location of the crane 20 aft of the center of flotation CF of the crane barge 10, loading the crane results in aft sinkage of the barge 10 about its center of flotation, causing the boom to incline from the vertical. Second, winds having a force component normal to the plane of the boom as it is lifting an object either over the side or the end of the barge 10 may cause the boom to incline, and therefore trim or list the crane barge through the moment connection from the boom crane 20 to the barge 10. In either case, the inclination of the crane boom must be limited to a very small angle, in some cases as small as one-fourth degree, to insure against collapse of the boom. In conventional crane barge construction, this design constraint may severely limit the length of the crane boom or the loads which may be lifted, and may limit use of the crane to times of low wind velocity.

Outrigger Barges

Control of listing and trimming of the crane barge, as well as maintenance of the crane boom substantially vertical, is achieved in the present invention by the provision of the outrigger barges 30 coupled to the crane barge 10, preferably at its sides 15, 16. The outrigger barges 30 here shown are generally of the deck type; in the preferred embodiment their length is about sixty feet, less than one-half that of the crane barge; their width is about twenty-eight feet and their vertical height six feet. Each outrigger barge 30 illustrated is of the wall-sided or box-type having a flat deck 31 and identical sides 32 and ends 33. The deck of the outrigger barge 30 has, as shown in FIG. 1, a centrally-mounted open-topped box construction 34, which is provided to receive cylinders containing concrete or sand ballast 35. The amount of ballast 35 provides is such that the draft of the outrigger barges 30 is substantially below their vertical mid-height, shown by the waterline $W_1$, in FIG. 2. Preferably, the draft should be at the mid-height when the crane 20 on the crane barge 10 is loaded, shown by waterline $W_2$ in FIG. 2, as will be described below. The vertical position of the ballast 35 is such that the outrigger barge 30 has positive stability.

The outrigger barges 30 are coupled to the sides 15, 16 of the central crane barge 10 by outrigger mounting structures, extending sideward from each side of the crane barge 10 to one of the outrigger barges 30, to space the sides 32 of the outrigger barges 30, in the preferred embodiment, approximately five inches or more from the sides of the crane barge 10. The outrigger mounting structure for each outrigger barge 30 is comprised, in the preferred embodiment, of a pair of spaced-apart beam and mount assemblies, each having a beam seat 40 at the crane barge 10 (a moment-resisting connection) from which the cantilever beams 60 extend to the pivot mount 50 (a structural hinge connection) over the transverse center of flotation of the outrigger barge 30, which is on its longitudinal centerline.

Each moment-resisting beam seat 40 illustrated is made up of a pair of side-by-side horizontally-placed short I-beams 41 welded to the deck 11 at the side of the crane barge 10 transverse to its centerline and spaced apart a sufficient distance to receive between them one of the cantilever beams 60. Each short I-beam 41 has a pair of horizontally-spaced-apart aligned horizontal beam seat bores 42 having bushings 43 mounted by strengthening gussets 44. A pair of removable pin connectors 45 may be mounted through the aligned bores 42 of the two I-beams 41.

The pivot mounts 50 on the outrigger barges 30 are made up of a pair of side-by-side vertically-placed short I-beams 51, welded to the barge decks transverse to their longitudinal centerlines and spaced apart a sufficient distance to receive between them the cantilever beam 60. Each of the short I-beams 51 has a bore 52 aligned, at the longitudinal centerline, with that of the other I-beam with which it is paired; these bores 52 have a bushing 53 secured by strengthening gussets 54. The aligned bores 52 of the two I-beams 51 receive a horizontal longitudinally-extending pivot pin 55. For ease of coupling of the barges 10, 30, described in detail below, the position of the bores 52 in the pivot mount 50 are at the same level as the pair of horizontally-spaced bores 42 in the beam seat 40 when the crane barge 10 is normally loaded, with the crane 20 mounted on it unloaded and the outrigger barge 30 ballasted, as shown in FIG. 2 by the disconnected outrigger barge shown in phantom lines.

Figure 2:
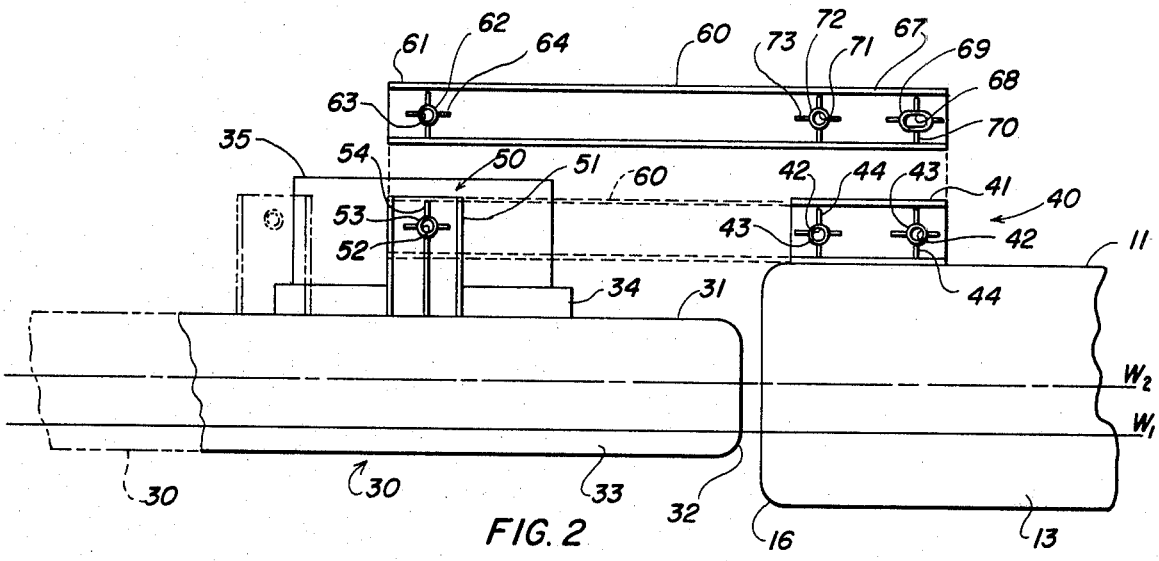
FIG. 2 is an enlarged aft end elevation of the beam coupling of the crane barge to one of the outrigger barges with the beam shown exploded upward in solid lines and connecting the two barges in dashed lines. Phantom lines show the outrigger barge prior to coupling to the crane barge.

The cantilever beam 60, best shown in FIG. 2, extends from the beam seat 40 to the pivot mount 50, coupling the crane barge 10 to the outrigger barge 30. In the preferred embodiment, the beam 60 is a horizontally-extending I-beam perpendicular to the longitudinal centerlines of both barges; it might alternatively be any type of beam or truss of sufficient strength. The outrigger end 61 of the beam 60 has a horizontal bore 62 with a bushing 63 mounted by strengthening gussets 64; the bore 62 may be aligned with the bores 52 of the pivot mount 50 to receive the pivot pin 55, forming a structural hinge. The crane barge end or inner end 67 of the cantilever beam 60 has a pair of bores spaces horizontally from each other and alignable with the spaced-apart bores 42 of the beam seat 40 to receive the removable pin connectors 45, forming a moment-resisting connection of the beam 60 to the crane barge 10 via the beam seat 40. As shown in FIG. 2, these bores include a horizontally-enlarged bore 68, nearest the end of the beam 60, having a bushing 69 mounted by gussets 70, and a cylindrical bore 71 spaced inward therefrom, similarly having a bushing 72 mounted by strengthening gussets 73. Alternatively, where the pair of aligned bores through the beam seat 40 and crane barge end 67 are not at the same level, either of the bores in the beam may be enlarged along a plane through the centers of the aligned bores.

In the preferred embodiment, four of such box-type outrigger barges 30 are coupled to the crane barge 10, two at its starboard side 15 and two at its port side 16. Preferably, the two outrigger barges 30 on each side of the crane barge 10 are on opposite sides of its longitudinal center of flotation, conveniently accommodated by positioning the two beam seats 40 for each aftmost outrigger barge 30 along opposite sides of the crane ring 12, which is mounted aft of the crane barge center of flotation CF. The longitudinal axes of the two outrigger barges 30 on each side of the crane barge 10 are aligned with each other.

Operation

The construction of the preferred embodiment permits temporary coupling of the outrigger barges 30 to the crane barge 10 when the crane 20 is used for lifting heavy loads considerable distances from the barge 10. The attached outrigger barges 30 give the crane barge 10 greater positive stability, reducing listing and trimming, and thereby minimize the sideward forces placed on the crane boom due to wind loads or aft sinkage of the barge 10 on lifting over the side. Where the crane barge 10 is to be transported, the outrigger barges 30 and the outrigger mounting structure are easily removed so that the crane barge 10 may pass through canals, locks and other narrow inland waterways.

In coupling the outrigger barge 30 to the crane barge 10, the cantilever beam 60 may first be mounted to the beam seat 40 by the removable connector pins 45. By the provision of the horizontally-enlarged bore 68 on the inward-extending end 67 of the beam 60, the two connector pins 45 are easily inserted even though the beam seat 40 or beam 60 should become slightly distorted or otherwise displaced from its original shape after repeated connection and disconnection. The horizontal enlargement of the bore 68 provides tolerance for the spacing of the two bores without introducing vertical play into the beam 60 at the moment connection to the beam seat 40. Once attached to the beam seat 40, the beam 60 extends sideward from the crane barge 10 substantially horizontally, in the preferred embodiment, positioned by the moment-resisting connection to the crane barge 10 by the beam seat 40.

In its ballast 35, the outrigger barge 30 has means to provide a desired or design draft such that with the crane barge 10 normally loaded with the crane 20 substantially unloaded, and the beam 60 so mounted, the bore 52 of the pivot mount 50 will be at the same level as the outrigger end bore 62 of the cantilever beam 60, as shown in FIG. 2. The pivot pin may therefore be easily inserted to attach the two barges 10, 30 together. After the attachment, substantially no vertical-acting force is presented upon the pivot pins 55 when the crane 20 is unloaded, so removal of the pivot pin 55 to detach the outrigger barge 30 is easily performed. Any remaining misalignment of the vertical positions of the pivot mount bore 52 and the outrigger end bore 62 of the beam 60 may be corrected by small jacks inserted between the beam 60 the outrigger barge deck 31, or if desired, by changing the amount of ballast 35. Since each outrigger barge 30 is coupled to the crane barge 10 by only two beam assemblies, alignment of the bores 52, 62 in the pivot mounts 50 and beam ends 61 and insertion of the pivot pin 55 is easily performed, even if one of the beams 60 should be slightly bent or the tolerances of other components similarly disrupted due to mishandling or normal wear and tear.

Use of the outrigger barges 30 coupled to the side of the crane barge serves to increase the intact stability of the crane barge 10 about its transverse center of flotation, as well as its longitudinal center of flotation. This added stability may be due to the lower level of the center of gravity of the barge system as a whole on the coupling of the outrigger barges 30 at water level, counteracting the great weight of the boom and weight suspended high above the water level. Hence, lowering the center of gravity increases GM, indicating a greater positive stability.

Figure 3:
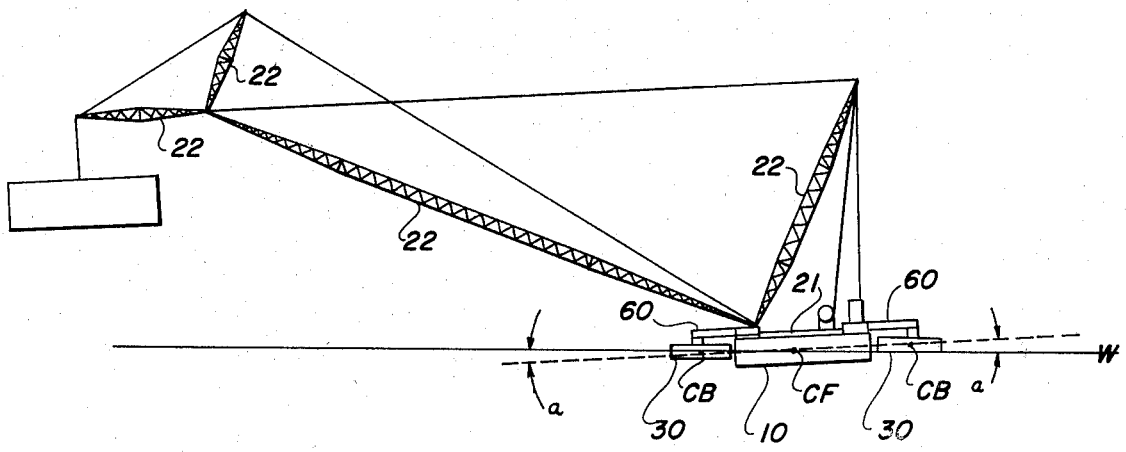
FIG. 3 is an aft end elevation of the preferred embodiment showing the minimal listing of the crane barge resulting from the crane lifting a load over the side of the barge.
Figure 4:
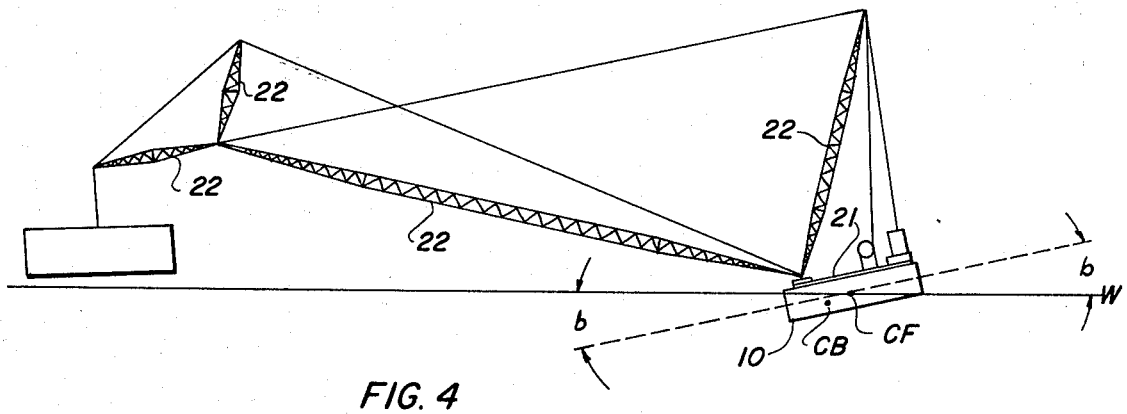
FIG. 4 is a view contrasting FIG. 3, showing the severe listing of a conventional crane barge in lifting such a load over the side of the barge.

As shown in the contrasting drawing FIGS. 3 and 4, the use of the outrigger barges 30 functions to minimize the list or heel of the crane barge 10. The weight of the boom and the bridge section illustrated as being lifted by it provide a heeling force tending to rotate and potentially capsize the crane barge 10. Each outrigger barge 30 acts to reduce the list of the crane barge 10 regardless of whether the list is toward or away from the outrigger barge. Where the crane barge 10 lists toward an outrigger barge 30, it is forced deeper into the water, increasing the upward buoyant force transmitted by the outrigger barge to the beam, which acts as a righting moment. Conversely, the outrigger barge 30 on the side opposite that to which the crane barge lists is lifted upward by the cantilever beam 60, reducing the draft of the outrigger barge, so that less of its weight is supported by the water and a greater downward load is presented on the beam 60; this load is likewise transferred as a righting moment to the crane barge 10.

By the structural hinge mounting of the outrigger barge 30 to the beam 60, the outrigger barge 30 does not list when the crane barge 10 lists due to an externally applied moment, as shown in FIG. 4. Thus, the deck of the outrigger barge 30 provides a level working surface upon which rigging and other duties may be safely performed, even when the deck is wet. The pivot connection relieves a portion of the bending stress in the beams 60, so smaller beams may be utilized. Since the bottom and deck 11 of the wall-sided outrigger barge are always parallel to the water plane, upon its being forced into or pulled upward from the water it will provide a buoyancy force on the beam which varies as a constant function over the angular range, from the point at which the outrigger barge 30 is lifted completely out of the water to the point at which the outrigger barge 30 becomes completely submerged. This affords a wider range of constant proportionality than if the outrigger barge 30 was fixed by a moment connection to the beam 60. The spacing of the outrigger barges 30 from the crane barge 10 is preferably great enough to assure that the outrigger barge 30 will not contact the crane barge 10 until the outrigger barge 30 has been completely lifted from the water. This, or a lesser angle, may be the maximum design angle of list of the crane barge. The weight of the ballast 35 for the outrigger barges 30 is chosen so that they may be substantially half submerged when a substantial load is lifted directly over the crane barge 10 by the crane 20. By so ballasting, the outrigger barges 30 will be partially submerged (neither completely submerged nor completely lifted from the water) for equal angles of list of the crane barge 10 to either direction.

The trimming of the crane barges is likewise reduced by use of the outrigger barges 30. In lifting over an end of a conventional crane barge, substantial trim of the barge may result. Inclusion of the outrigger barges 30 on the sides of the crane barge 10 minimizes this unsatisfactory condition.

Figure 5:
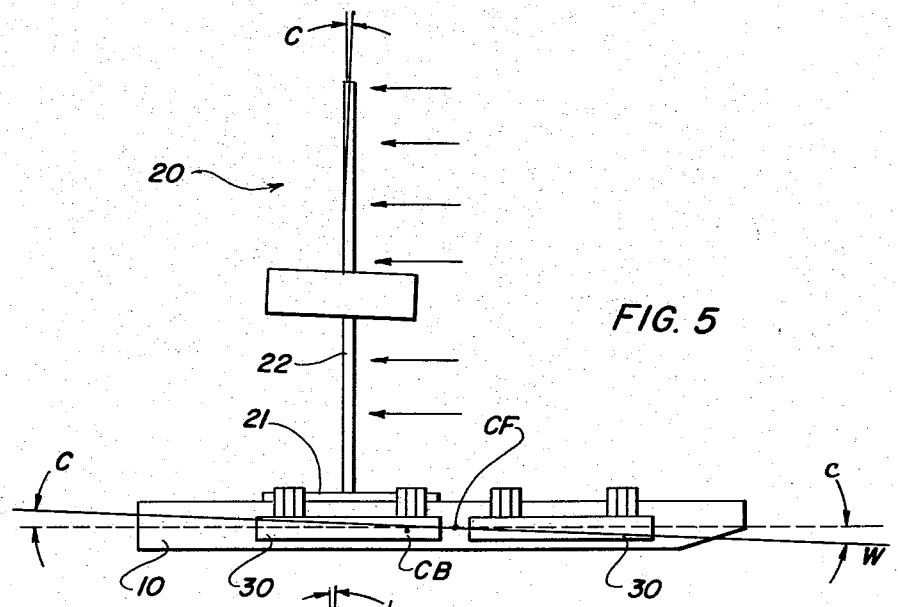
FIG. 5 is an elevation of the preferred embodiment seen from its starboard side, showing the minimal trim which results when a crane barge mounted aft of the center of flotation of the crane barge is utilized to lift a load over the side of the barge, when encountering a wind load normal to the plane of the crane boom.
Figure 6:
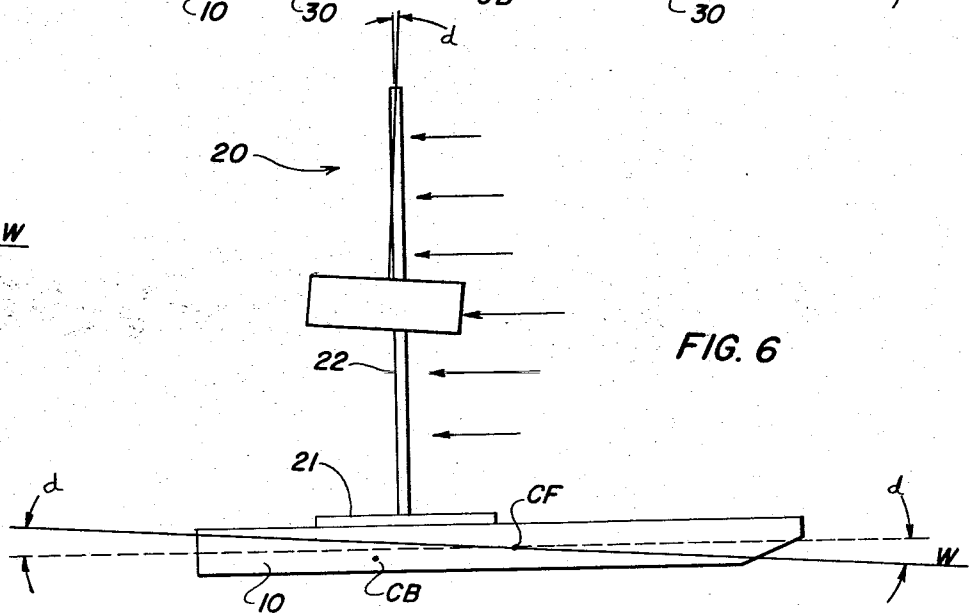
FIG. 6 is a view contrasting FIG. 5, showing the severe trimming of a conventional crane barge in lifting such a load over the side of the barge.

FIGS. 5 and 6 demonstrate the inclination of the crane boom in the preferred embodiment and in a conventional crane barge, caused by trimming of the crane barge 10 due to location of the crane 20 aft of the center of flotation of the crane barge 10 and due to wind loads on the boom in lifting over the side of the barge. As described above, in either of these cases, the crane barge 10 rotates about its center of flotation CF forward of the mounting of the crane 20, causing the boom of the crane 20, when lifting over the side of the barge, to incline from vertical. As shown in FIG. 6, this rotation of the boom through angle d is transferred as a trimming moment to the crane barge. The inclination of the boom from the vertical position results in a sideward force component on the boom produced by its weight and the load supported by it, which may collapse the truss-like boom. Similarly, the wind load on the side of the boom and on the structure being lifted by the boom may cause the barge to trim on lifting over the side, as shown in FIG. 6, or to list, on lifting over the end of the crane barge 10, in either case inclining the boom from vertical and possibly causing its collapse. In another situation, lifting over one of the rear corners of the crane barge may result in greater listing of the barge than trimming, in such manner that the boom will be inclined from the vertical. This is possible because the barge is of much greater length than width.

As shown in FIG. 5, these problems are minimized by attachment of the outrigger barges. The trimming moment caused by either the wind load or the added weight aft of the center of flotation CF of the crane barge pushes the aft outrigger barges downward into the water, causing a greater upward buoyant force on the beams 60. Correspondingly, the forward outrigger barges are lifted upward, decreasing their draft and increasing the downward load on the beams. Trimming of the crane barge is thus minimized to the angle c, whether due to the aft sinkage or to the normal wind force. Listing of the crane barge 10 caused by wind loads on the boom when lifting over an end of the crane barge 10 is also minimized by this construction. Thus, likelihood of collapse of the crane boom is greatly decreased.

By location of the beam assemblies on opposite sides of the longitudinal center of flotation of the crane barge, the shear forces on each individual outrigger barge, caused by trim of the crane barge, are minimized.

Modifications and Alternate Embodiments

Figure 7:
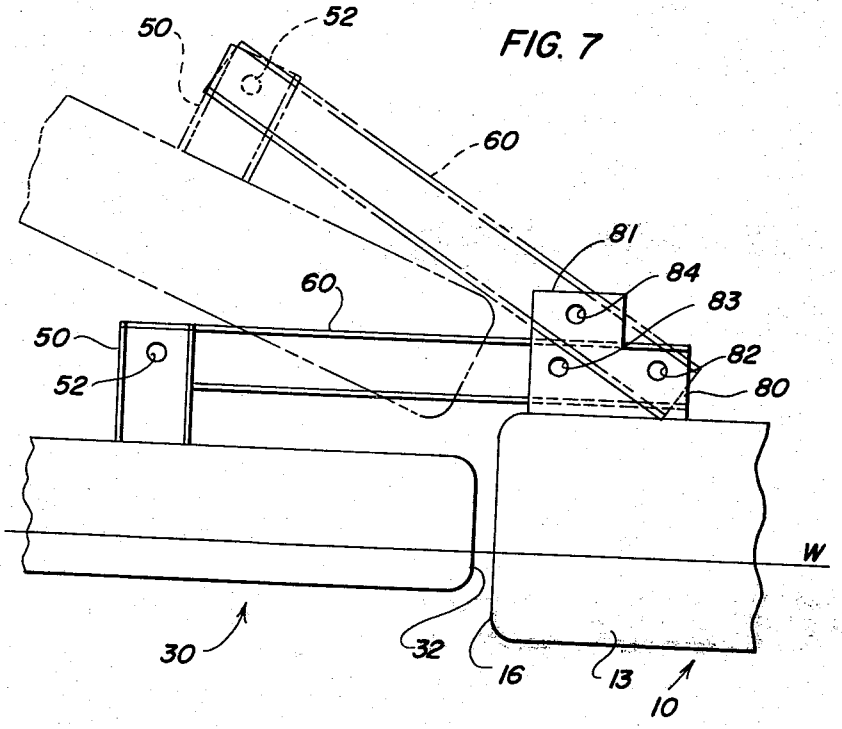
FIG. 7 is a schematic aft end elevation showing a modified embodiment by which the outrigger barge may be suspended over the water plane for transport, as shown in phantom lines.

The above described floating crane barge system shown in FIGS. 1–6 is merely a preferred embodiment of the present invention. As a simple alternative embodiment, shown schematically in FIG. 7, means may be provided for suspending the outrigger barges above the waterline by rotation of the cantilever beams upward in their beam seats. As shown in FIG. 8, the beam seat, generally designated 80, is made up of a pair of side-by-side supports 81 having a pivot bore 82 spaced from the edge of the deck and a pair of bores nearer the edge of the deck 11, including a lower bore 83 spaced horizontally from the pivot bore 82 and an upper bore 84 spaced above the lower bore 83 along an arc whose center is the pivot bore 82. The pivot and lower bores 82, 83 are of sufficient height above the deck of the crane barge and the lower inner end 67 of the beams 60 are so rounded as to provide clearance permitting angular beam movement relative to the rear pivot bore 82. Thus, on removal of the forward pins, the beams 60 may be rotated to lift the outrigger barges from the water, such as for transport. The upper bore 84 provides means for retaining the beams in the rotated position, by accepting one of the removable connector pins 45.

Other modifications and embodiments are contemplated. For example, vessels other than barges subject to unsymmetrical and shifting loads may benefit from provision of the outrigger vessels coupled by outrigger mounting structure having a structural hinge so that the outrigger vessel may pivot. The structural hinge may be a pivot pin, as shown, or other types of joints, such as ball joints constructed to permit pivoting about a longitudinal axis and in some cases about a transverse axis as well. Thus, using only a single beam or truss per outrigger, the outrigger will always maintain the same horizontal orientation whether the crane barge trims or lists.

The location and number of outrigger barges provided may be varied as required. Symmetry of position of the barges is not required; for example, they may be mounted at the ends of the crane barge, as well as at its sides. The outriggers may be other types of barges, such as of the hopper type, or may be any floating object having positive stability. From these examples other modifications will suggest themselves.

I claim:

1. A floating crane construction comprising a crane barge having a crane mounting provision on its upper side, substantially on its longitudinal centerline, in combination with a pair of outrigger barges, and outrigger mounting structures, one extending sideward from each side of the crane barge to one of said outrigger barges, each outrigger mounting structure including connection means for coupling each of the said outrigger mounting structures to an outrigger barge, and a moment-resisting connection to the crane barge, whereby listing on increased loading of the crane barge creates a substantially vertical-acting force at the connection means which is resisted by the buoyancy of the outrigger barge, at least one of said connection means and said moment-resisting connection having a removable pin connector, together with means to so ballast the outrigger barges that upon normal loading of the crane barge with a substantially unloaded crane mounted on said crane mounting provision, the draft of both outrigger barges is such as to create substantially no vertical-acting forces at the removable pin connectors, whereby to facilitate coupling and uncoupling of the outrigger barges.

2. The floating crane construction defined in claim 1, wherein said outrigger mounting structure connection means for coupling to the outrigger barge comprises a structural hinge having a pivot pin substantially parallel to said longitudinal centerline of the crane barge, whereby upon listing of the crane barge, the outrigger mounting structure may pivot on said connection means, and thereby the outrigger barge is not caused to list.

3. The floating crane construction defined in claim 1, together with a second pair of outrigger barges, one on each side of said crane barge and having its longitudinal centerline aligned with that of an outrigger barge of said first pair, similar outrigger mounting structures therefor, and similar means to so ballast said second pair of outrigger barges.

4. The floating crane construction defined in claim 1, wherein the outrigger barges are of the type having substantially vertical walls, whereby to afford resistance to listing which is proportionate to the angle of list.

5. A floating crane construction, comprising a crane barge having a crane mounted on its upper side substantially on its longitudinal centerline and aft of its longitudinal center of flotation, an outrigger barge whose length is less than half that of the crane barge, and outrigger mounting structure including a pair of spaced-apart beam means, extending sideward from a pair of moment-resisting connections at the crane barge, both located at the same side of its longitudinal center of flotation, to connection means at the outrigger barge, whereby to minimize shearing forces on the outrigger barge when loading of the crane affects the trim of the crane barge.

6. The floating crane construction defined in claim 5, and further comprising a second similar outrigger barge coupled at the same side of the crane barge as the first outrigger barge by a corresponding outrigger mounting structure, the moment-resisting connection of each beam means of said corresponding structure being at that side of the longitudinal center of flotation of the crane barge opposite to the said moment-resisting connections of the beam means of said first outriger barge.

7. The floating crane construction defined in claim 5, wherein said outrigger mounting structure connection means for coupling to the outrigger barge is a structural hinge having a pivot pin substantially parallel to said longitudinal centerline of the crane barge, whereby the outrigger barge pivots on said connection means upon listing of the crane barge, and thereby does not list.

8. A floating crane construction, comprising a crane vessel having a crane mounting provision on its upper side, an outrigger vessel of the type having substantially vertical walls, outrigger mounting structure extending from the crane vessel to the outrigger vessel, the outrigger mounting structure including a moment-resisting connection to the crane vessel, and a structural connection to the outrigger vessel, said connection having means to permit pivoting about an axis substantially parallel to the longitudinal centerline of the crane vessel, said connection being positioned substantially over the transverse center of flotation of the outrigger vessel.

9. The floating crane construction defined in claim 8, wherein the outrigger mounting structure spaces the outrigger vessel to the side of the crane vessel by such a distance as to accommodate a design angle of list of the crane vessel, whereby, on listing within such design angle, to avoid contact between the adjacent sides of the crane vessel and outrigger vessel.

10. The floating crane construction defined in claim 8, wherein each outrigger vessel is so ballasted that its normal draft, under the condition of substantially no vertical-acting forces at its said structural connection to the outrigger mounting structure, is substantially below the vertical mid-height of the outrigger vessel, whereby on substantial loading of the crane the draft of the outrigger vessel may be so increased that the outrigger vessel will remain in a partially submerged position for approximately equal list of the crane vessel to either port or starboard, thereby affording a resistance to listing which is at all times proportionate to the list angle of the crane vessel.

11. A floating crane construction comprising a crane barge having a crane mounting provision on its upper side substantially on its longitudinal centerline, an outrigger barge, outrigger mounting structure comprising (a) a pair of spaced-apart cantilever beam means extending sideward from the crane barge to the outrigger barge, (b) moment-resisting connections between the cantilever beam means and the crane barge, and (c) a structural hinge connection between each cantilever beam means and its outrigger barge, each said hinge connection including a pivot pin substantially parallel to the longitudinal centerline of the crane barge and located substantially over the transverse center of flotation of the outrigger barge, the said cantilever beams being so supported by their moment-resisting connections as to position said structural hinge connections at substantially the same height, when an unloaded crane is mounted on said mounting provision, as that height established for said connections by the draft of the outrigger barge when disconnected, whereby when a crane so mounted is loaded, the outrigger barge is pressed downward at its hinge connections to increase its buoyancy.

12. The floating crane construction defined in claim 11, wherein each moment-resisting connection at the crane barge includes a beam seat and a pair of parallel horizontal transverse removable pins through aligned bores in the beam seat and beam means, whereby on uncoupling of the outrigger barge, the sideward-extending cantilever beam means is removable.

13. The floating crane construction defined in claim 12, wherein the aligned bores in the beam seat and beam means are spaced horizontally from each other, and one of the bores in the beam means is horizontally enlarged, whereby to facilitate insertion of the pins without introducing vertical play in the moment-resisting connection to the beam means.

14. The floating crane construction defined in claim 12, wherein one of the bores in the beam means is enlarged along a plane through the centers of said aligned bores, whereby to facilitate insertion of the pins without introducing vertical play in the moment-resisting connection to the beam means.

15. The floating crane construction, defined in claim 11, wherein the outrigger barge is spaced from the crane barge, by the outrigger mounting structure, by such distance as to accommodate a design angle of list of the crane barge prior to contact of the adjacent sides of the crane barge and outrigger barge.

16. The floating crane construction defined in claim 11, and further comprising a second outrigger barge, and corresponding outrigger mounting structure therefor both on the side of the crane barge opposite that of said outrigger mounting structure for the first outrigger barge.

17. A floating crane construction, comprising a crane barge having a crane mounting provision on its upper side substantially on its longitudinally-extending centerline aft of its longitudinal center of flotation, a plurality of smaller outrigger barges at the sides of the crane barge, a pair of parallel beam-and-mount assemblies for each outrigger barge, each said assembly including a moment-resisting beam seat on the upper side of the crane barge having a pair of horizontally-spaced-apart horizontal beam seat bores and removable pins therein extending parallel to said centerline of the crane barge, a pivot mount substantially over the transverse center of flotation of the outrigger barge and there having a pivot pin bore and pin therein, and a beam extending sideward from an inner beam end at the beam seat on the crane barge to an outer beam end at the pivot mount on the outrigger barge, said beam ends having bores alignable with the pair of beam seat bores and the pivot pin bore, respectively.

18. The floating crane construction defined in claim 17, wherein the outrigger barges are spaced from the crane barge by said beam-and-mount assemblies by such distance to accommodate a maximum design list of the crane barge without the adjacent sides of the crane barge and outrigger barges contacting, whereby on such listing of the crane barge on the outrigger barges may provide a level working surface.

19. The floating crane construction defined in claim 17, wherein one of said bores in each beam seat is horizontally enlarged, whereby to facilitate insertion of the said removable pins without introducing vertical play in the connection of the beam to the beam seat.

20. The floating crane construction defined in claim 17, wherein each outrigger barge is of the box type, and each outrigger is so ballasted that its draft is normally substantially below its vertical mid-height, and wherein the beams are so positioned by their beam seats that for normal substantially unloaded condition of the crane no substantial vertical load is transmitted between the crane barge and the outrigger barge, whereby to facilitate coupling of the outrigger barge to the crane barge.

21. The floating crane construction defined in claim 17, wherein each beam seat is provided with such clearance as to permit angular beam movement relative to one of the horizontal beam seat bores, whereby on removal of the pins from the others of said pair of seat bores, the beams may be rotated to lift the outrigger barges connected thereto from the water, together with means at each beam seat for retaining the beams in such rotated position.

22. The floating crane construction defined in claim 21, wherein said means at each beam seat for retaining the beams in such rotated position comprise a third horizontal bore in the beam seat so spaced from, and at a different level than the beam seat bores about which the beam may be so angularly moved, as to accept the pin so removed.

* * * * *

UNITED STATES PATENT AND TRADEMARK OFFICE

CERTIFICATE OF CORRECTION

PATENT NO. : 4,297,961

DATED : November 3, 1981

INVENTOR(S) : Fontain M. Johnson, Jr.

It is certified that error appears in the above—identified patent and that said Letters Patent is hereby corrected as shown below:

In column 3, line 45, delete "over" and substitute ---above---;

In column 5, line 57, delete "provides" and substitute ---provided---;

In column 7, line 60, after "beam 60" insert ---and---;

In column 14, line 6, delete "on" after "barge".

Signed and Sealed this

*Twenty-sixth* Day of *January 1982*

[SEAL]

*Attest:*

*Attesting Officer*

GERALD J. MOSSINGHOFF

*Commissioner of Patents and Trademarks*